US008460051B2

(12) United States Patent
Rudell et al.

(10) Patent No.: US 8,460,051 B2
(45) Date of Patent: Jun. 11, 2013

(54) WATER ID TECHNOLOGY TOYS AND TOY PLAYSETS

(75) Inventors: Elliot Rudell, Torrance, CA (US); William Byles, Los Angeles, CA (US); Roger Gardner, Lomita, CA (US)

(73) Assignee: Rudell Design LLC, Torrance, CA (US)

( * ) Notice: Subject to any disclaimer, the term of this patent is extended or adjusted under 35 U.S.C. 154(b) by 2097 days.

(21) Appl. No.: 11/246,329

(22) Filed: Oct. 6, 2005

(65) Prior Publication Data

US 2007/0021028 A1 Jan. 25, 2007

Related U.S. Application Data

(60) Provisional application No. 60/701,911, filed on Jul. 25, 2005.

(51) Int. Cl.
*A63H 23/00* (2006.01)

(52) U.S. Cl.
USPC ..... 446/153; 446/175; 446/484

(58) Field of Classification Search
USPC ..... 446/153–154, 156, 158, 180
See application file for complete search history.

(56) References Cited

U.S. PATENT DOCUMENTS

| | | | | |
|---|---|---|---|---|
| 4,314,423 | A * | 2/1982 | Lipsitz et al. | 446/303 |
| 5,989,091 | A * | 11/1999 | Rodgers | 446/153 |
| 6,165,036 | A * | 12/2000 | Hino et al. | 446/154 |
| 7,017,911 | B1 * | 3/2006 | Chia | 273/442 |
| 2004/0214642 | A1 * | 10/2004 | Beck | 463/40 |

FOREIGN PATENT DOCUMENTS

GB 1591084 A * 6/1981

OTHER PUBLICATIONS

STIC Search results.*
GB 1591084 A.*

* cited by examiner

*Primary Examiner* — Dmitry Suhol
*Assistant Examiner* — Alex F. R. P. Rada, II
(74) *Attorney, Agent, or Firm* — Ben J. Yorks; Irell & Manella LLP

(57) ABSTRACT

A toy system that can be used in a body of water. The system includes a plurality of toy accessories that can be placed in the water. Placement of a toy accessory into the water activates the accessory to generate a signal. The signal is received by a base station. The base station generates an output in response to the signal. By way of example, the base station can generate a speech pattern. Each toy accessory may provide a unique code to the base station. Each code may generate a different speech pattern.

12 Claims, 6 Drawing Sheets

CODE

| | | |
|---|---|---|
| 00 | JET SKI | 1 OF THE 3 UNITS HAS 2 SWITCHABLE SOUNDS |
| 01 | YELL | |
| 10 | DOLPHIN | |
| 11 | GIGGLE | |

WATER ID TECHNOLOGY TOYS AND TOY PLAYSETS

REFERENCE TO RELATED APPLICATION

This application claims priority to provisional Application No. 60/701,911 filed on Jul. 25, 2005.

BACKGROUND OF THE INVENTION

1. Field of the Invention

The present invention relates to a toy system that operates in a body of fluid.

2. Prior Art

There have been developed various toys that operate in and/or with water. For example, there are various remote controlled toys that can travel across a body of water. Remote controlled toys in general do not provide an educational function. The users merely control the direction and speed of a vehicle.

There have been developed a number of edutainment toys. By way of example, Fisher Price and LEAPFROG have sold electronic games under the trademarks POWER TOUCH and LEAPPAD, respectively. These products provide different speech commands and statements in response to input from the user. With these products different cartridges, books, etc. can be loaded onto an electronic board to provide different story play for the user. Neither POWER TOUCH or LEAPPAD can be used in water.

U.S. Pat. Nos. 5,939,983; 6,062,936; 6,054,156; 6,163,258 and 6,325,693 issued to Rudell et al. disclose a concept where a user completes an electrical path of a circuit of a toy device. The toy device may support a food substance such as a popsicle. The device has two electrodes, one electrode in contact with the popsicle and the other in a handle of the device. When the user grabs the handle and consumes the popsicle, he/she provides a path for electrical current between the electrodes. Closing this circuit creates some type of output such as a sound or the illumination of a light source.

Tomy Toys sold a product under the name SING AND DANCE DOLPHINS that emitted a sound when placed in a body of water.

It would be desirable to provide an edutainment system that can be used in and interact with a body of water.

BRIEF SUMMARY OF THE INVENTION

A toy system that can be operated in a body of fluid. The system includes a toy accessory that can be placed in the body of fluid and emit a signal with an identification unique to the accessory. The signal can be received by a base station that generates an output.

DETAILED DESCRIPTION

Disclosed is a toy system that can be used in a body of water. The system includes a plurality of toy accessories that can be placed in the water. Placement of a toy accessory into the water activates the accessory to generate a signal. The signal is received by a base station. The base station generates an output in response to the signal. By way of example, the base station can generate a speech pattern. Each toy accessory may provide a unique code to the base station. Each code may generate a different speech pattern.

Figure 1:
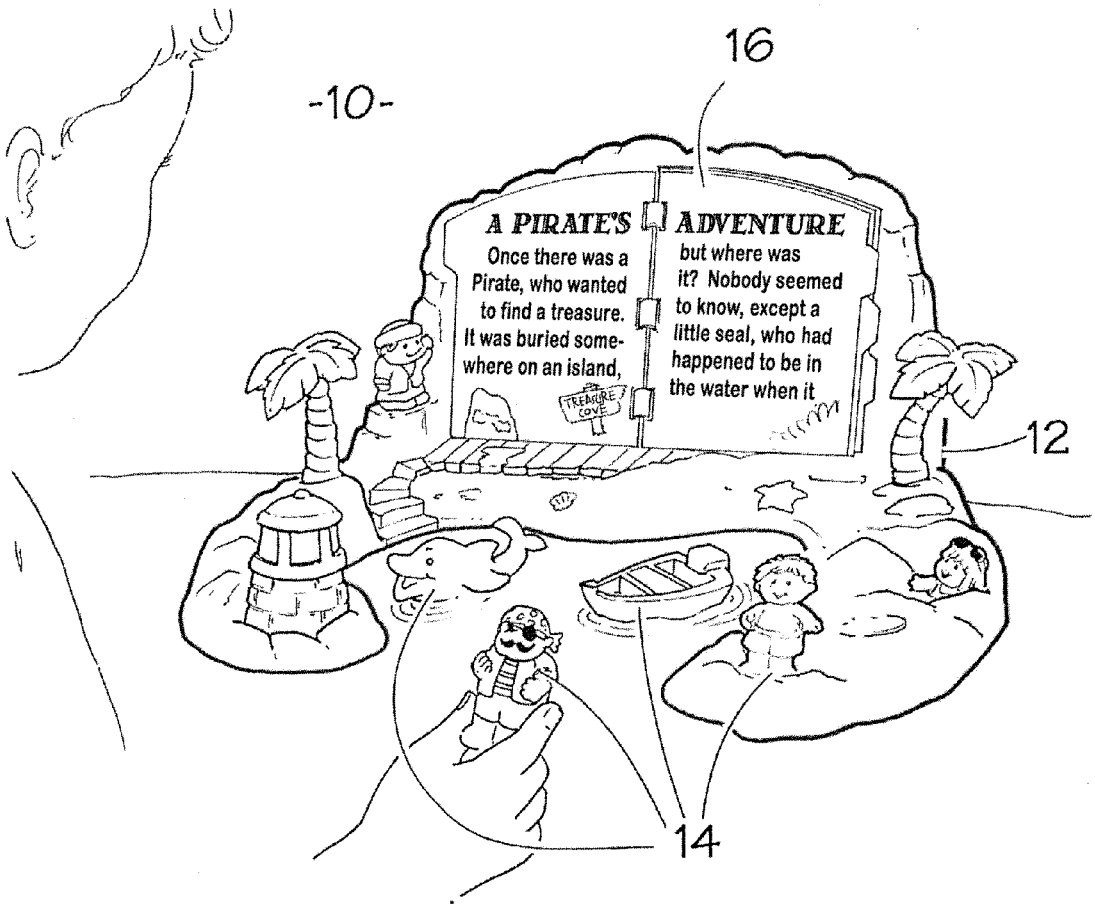
FIG. 1 is an illustration of a toy system used in a body of fluid.

Referring to the drawings more particularly by reference numbers, FIG. 1 shows a toy system 10 that can be operated in a body of fluid. By way of example, the body of fluid can be a bath tub filled with water. The toy system 10 may include a base station 12 and a plurality of toy accessories 14. Toy accessories 14 may be shaped as different toy characters. The station 12 may support a book 16. The base station 12 may contain electrical circuits that generate speech. The base station 12 may generate speech that corresponds to the text of the book. The base station 12 may have sensors, such as microswitches that are positioned so that a particular microswitch is activated by a corresponding tab at the top of each page of the book, or other devices that allow the station 12 to identify different books and/or different pages of a book. The station 12 may generate different speech for different books and/or different pages of the books.

The toy accessories 14 may transmit a code(s) to the base station 12 when placed in water. The base station 12 may generate a speech pattern based on which accessory is placed in the water. For example, the base station 12 may begin to talk about a pirate character in the book if a pirate shaped accessory is placed in the water.

The base station 12 may prompt the user to place one of the accessories into the water. For example, the base station 12 may generate a statement "place a boat in the water". If the user places the boat accessory into the water the base station 12 may generate more speech about the boat, and the role of the boat in the story. If the user puts in the wrong accessory the base station 12 may generate a statement such as "that is not a boat". This provides an educational function for the system, where the user has to accurately identify the different characters. Alternatively, the base station 12 may prompt the user to place a particular accessory into the water, and the user's selection might thereby determine the further direction of the story.

Figure 2:
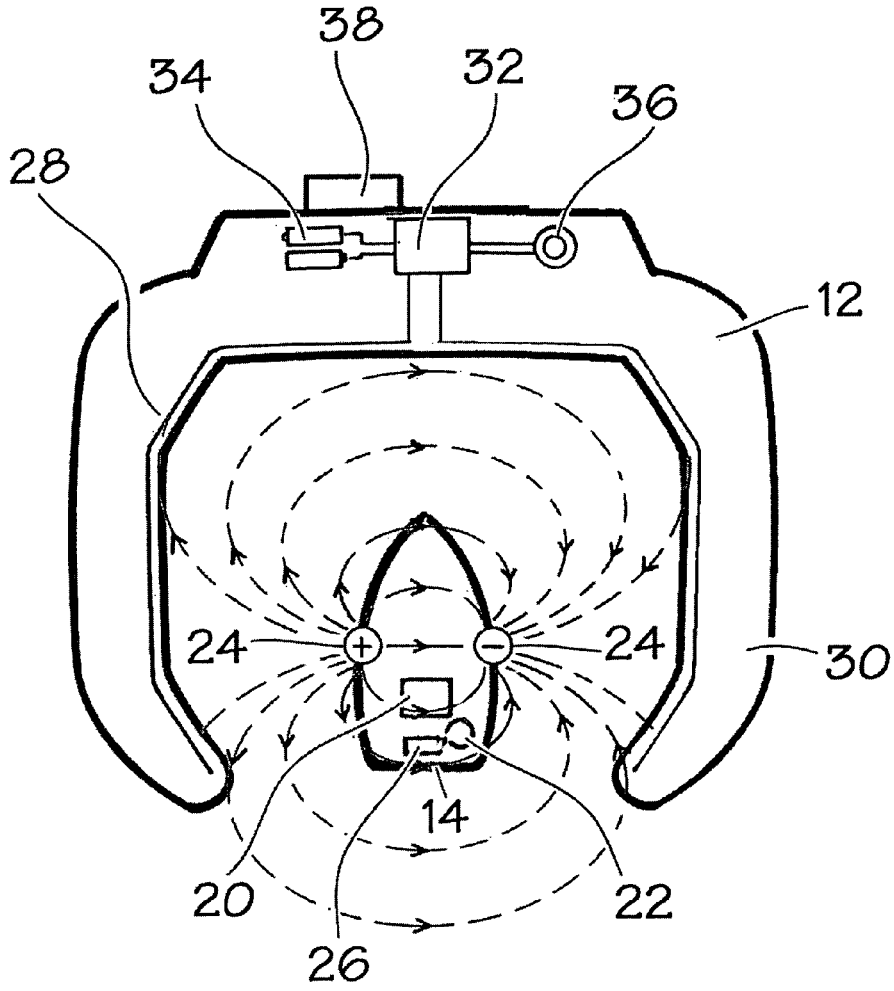
FIG. 2 is a schematic showing a toy accessory providing a signal to the base station.

FIG. 2 is a schematic showing interaction between the base station 12 and accessory 14. The accessory 14 may include a processor 20 coupled to a battery 22 and a pair of electrodes 24. The accessory 14 may also have an on/off switch 26 connected to the battery 22. The processor 20 causes the electrodes 24 to emit an electrical signal that is transmitted into the water.

The base station 12 may include a pair of electrode antennas 28 that are submerged in the water. The electrodes 28 may be embedded in a water sealed housing 30. The electrodes 28 are connected to a processor 32. The processor 32 may also be connected to a battery(ies) 34 and a speaker 36. The base station 12 may also have non-volatile and/or volatile memory (not shown).

The processor 32 may operate in accordance with data and operations of a software program. The data and/or operations may be provided by a removable cartridge 38. Different cartridges can be associated with different books and stories.

The accessory processor 20 may cause the electrodes 24 to emit a code that is unique to the accessory 14. The code is decoded by the base station processor 32. The code may cause certain interrupts and/or calls in the system software. For example, the processor 32 may generate speech that tells a story line. The placement of the accessory into the water will generate a signal that creates an interrupt and/or call to a difference part of the story.

Figure 3:
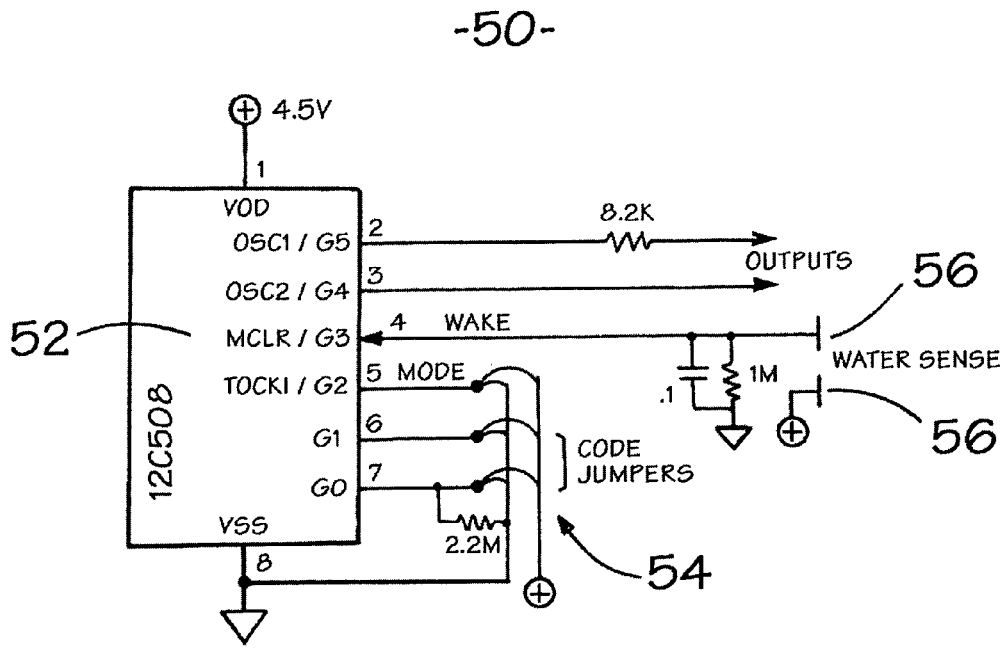
FIG. 3 is a schematic of a circuit for a toy accessory.

FIG. 3 shows an example of circuit 50 for an accessory 14. The circuit 50 may include a transmitter integrated circuit 52 that transmits a code defined by jumpers 54. The accessory 14 may have activation electrodes 56 that are connected to the integrated circuit 52. When the accessory is out of water there is an open circuit between the electrodes 56 and the integrated circuit 52 is not activated. When the accessory 14 is placed in a body of water, the water closes the circuit between the electrodes 56, and the integrated circuit 52 is activated and transmits the coded signal. Alternatively, the circuit of the accessory 14 might be activated by an ON/OFF switch activated by the user. The output of the circuit 52 may be provided to electrodes 24 (see FIG. 2). Alternatively, the output of the circuit may be provided to an inductive coil (not shown) that functions as an antennae.

Figure 4:
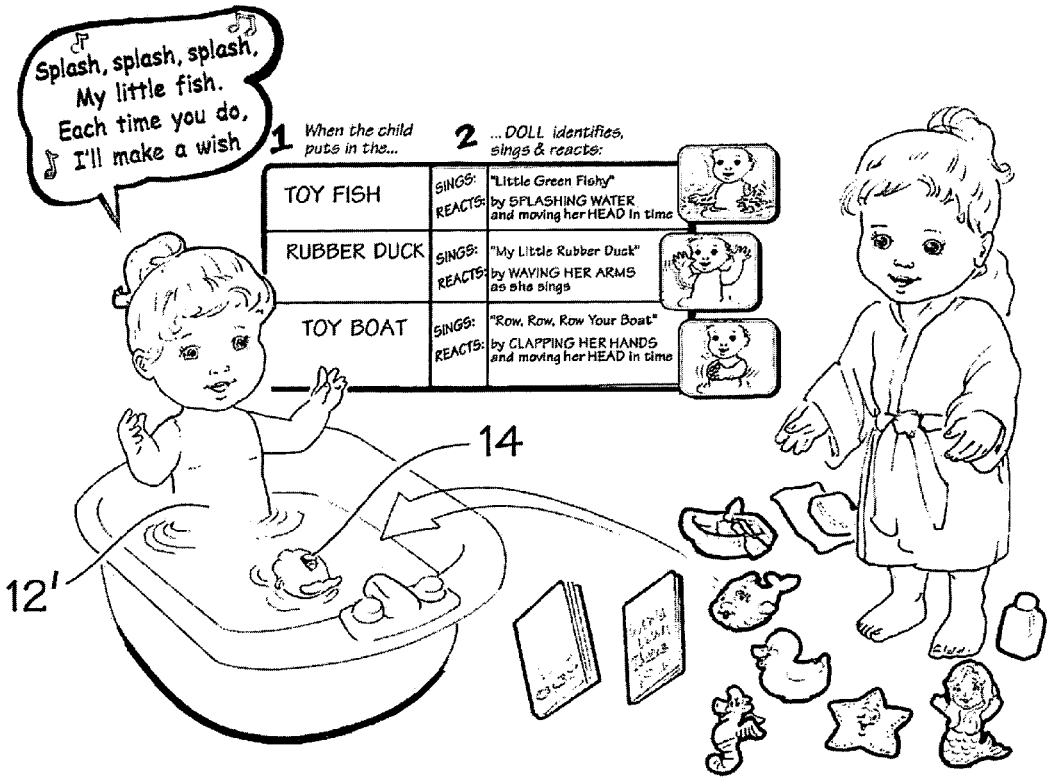
FIG. 4 is an illustration of an alternate embodiment of the system.
Figure 5:
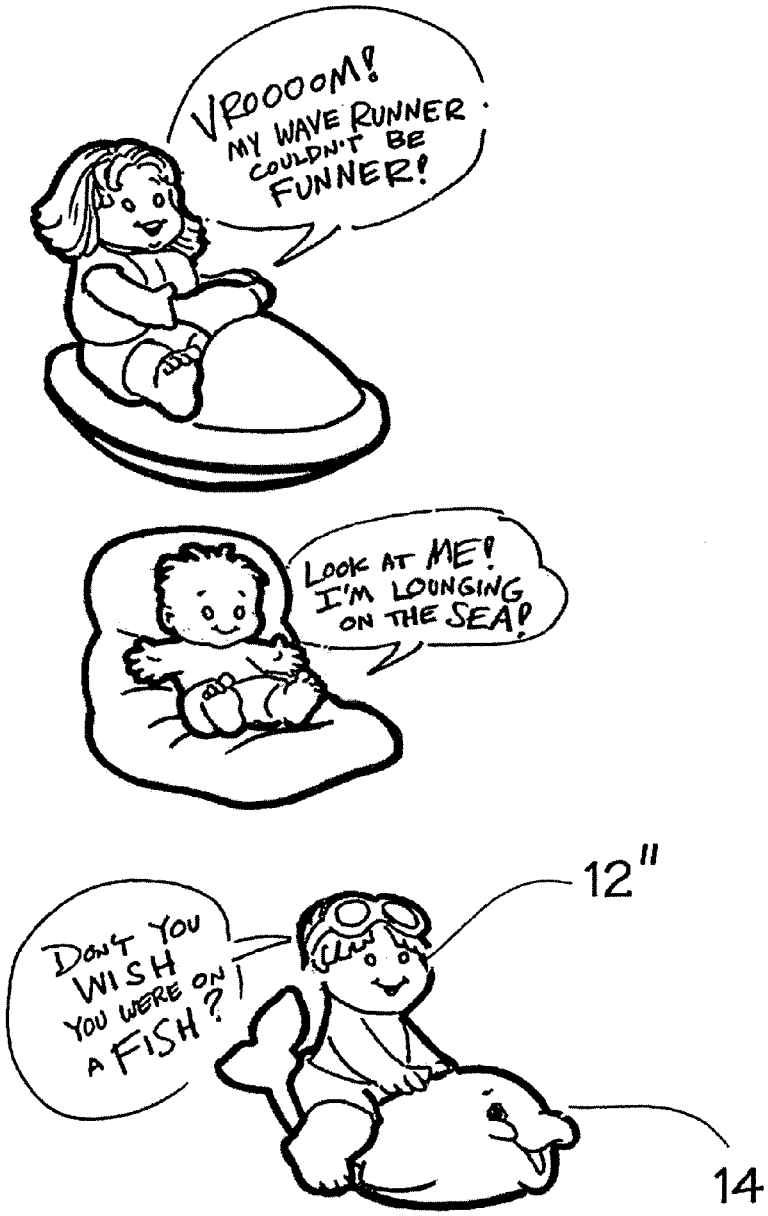
FIG. 5 is an illustration of an alternate embodiment of the system.

FIG. 4 shows an alternate embodiment where the base station 12' is shaped as a doll. The doll 12" contains a processor, speaker, etc., to generate speech in response to codes transmitted by accessories 14 placed in the water. The doll 12' may generate speech in reaction to the type of accessory 14 placed in the water. Alternatively, the doll 12' may include a motor and gear mechanism, as is commonly known to those skilled in the art, to cause the doll 12' to move a limb or limbs in response to a particular code transmitted by an accessory 14. For example, doll 12' might clap when one accessory 12 is placed into the water. The doll 12' may wiggle its hands when a different accessory 14 is placed into the water. As shown in FIG. 5, the doll 12" can be configured to be small enough for placement on an accessory 14. Placing the doll 12" onto a different accessory may generate a different speech pattern.

Figure 6:
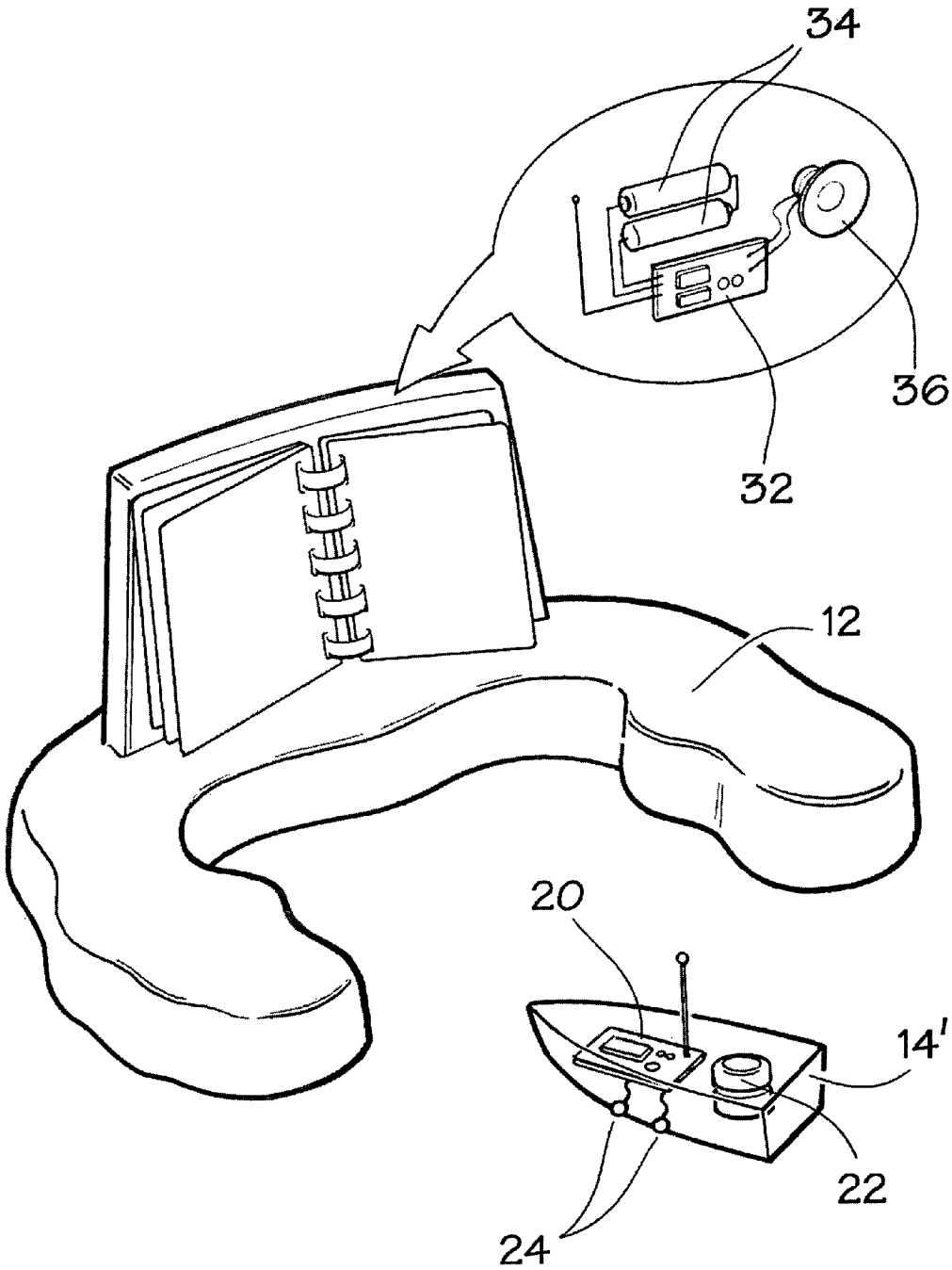
FIG. 6 is an illustration of an alternate embodiment of the system.

FIG. 6 is another alternate embodiment, wherein the signal is transmitted by an accessory 14' through the air, instead of, or in addition to, transmission through the water. In this embodiment, the base station antennas (not shown) are located above the water.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

For example, the output of the base station may include activating a motor or illuminating a light source. Furthermore, it should be understood that the functions of the base station and accessories could be reversed, with the base station sending signals to the accessories, and the accessory responding to the base station. The base station and accessories can be referred to as a first toy component and a second toy component or vice versa.

What is claimed is:

1. A toy system that can be operated in a body of liquid, comprising:

a first toy component that can be placed in the body of liquid and emit a signal through the liquid, said signal includes an identification unique to said first toy component;

a second toy component that can be placed in the body of liquid and emit a signal through the liquid, said signal includes an identification that is unique to said second toy component; and, a base station that generates a storyline, said storyline includes a message that is dependent upon whether a user places said first toy component or said second toy component in the body of liquid.

2. The toy system of claim 1, wherein said first toy component includes a pair of electrodes and the liquid provides an electrical path between said electrodes.

3. The toy system of claim 1, wherein said unique identification is a code.

4. The toy system of claim 1, wherein said second toy component includes an antennae coupled to a processor.

5. The toy system of claim 1, wherein said base station generates a speech pattern that is unique to said first toy component.

6. The toy system of claim 1, wherein said second toy component includes generating speech commands.

7. The toy system of claim 1, wherein said output includes activating a motor.

8. The toy system of claim 1, wherein said second toy component includes a removable cartridge that provides a plurality of selectable outputs.

9. A method for operating a toy system in a body of liquid, comprising:

providing a first toy component and a second toy component that can each transmit a unique identification;

communicating a storyline from a base station, the storyline including a message that is dependent on whether a user has placed a first toy component or a second toy component in the body of liquid placing the first toy component in a body of liquid;

transmitting a unique identification signal from the first toy component into the liquid;

receiving the unique identification signal at the base station; and, generating a message by the base station that is dependent on the unique identification signal received from the first toy component.

10. The method of claim 9, wherein the output includes a speech pattern that is unique to the first toy component.

11. The method of claim 9, further comprising generating speech commands from the base station.

12. The method of claim 9, wherein the output includes activating a motor.

* * * * *